US005476394A

United States Patent [19]

Sugihara et al.

[11] Patent Number: 5,476,394

[45] Date of Patent: Dec. 19, 1995

[54] ANTENNA CONNECTOR

[75] Inventors: Yoshinori Sugihara; Kazuo Dougauchi, both of Nagaokakyo, Japan

[73] Assignee: Murata Manufacturing Co., Ltd., Nagaokakyo, Japan

[21] Appl. No.: 230,912

[22] Filed: Apr. 21, 1994

[30] Foreign Application Priority Data

Apr. 23, 1993 [JP] Japan ..... 5-097520

[51] Int. Cl.[6] ..... H01R 33/00

[52] U.S. Cl. ..... 439/620; 439/34

[58] Field of Search ..... 439/620, 34; 333/12

[56] References Cited

U.S. PATENT DOCUMENTS 2,865,006 12/1958 Sabaroff ..... 333/12 X 4,173,742 11/1979 Lehmann ..... 333/12 X 4,267,529 5/1981 Brun et al. ..... 333/12

5,091,707 2/1992 Wollmerhauser et al. ..... 333/12

*Primary Examiner*—David L. Pirlot

*Assistant Examiner*—Jill DeMello

*Attorney, Agent, or Firm*—Burns, Doane, Swecker & Mathis

[57] ABSTRACT

An antenna connector which has a magnetic core, a signal line wound around the magnetic core at least once, a high-frequency appliance side terminal and an antenna side terminal. The magnetic core and the signal line form a common mode choke coil. The high-frequency appliance side terminal is electrically connected with a signal line of a television or the like, and the antenna side terminal is electrically connected with an antenna lead-in wire.

18 Claims, 2 Drawing Sheets

ANTENNA CONNECTOR

BACKGROUND OF THE INVENTION

1. Field of the Invention

The present invention relates to an antenna connector, and more particularly to an antenna connector which is used to transmit a signal received by an antenna to a high-frequency appliance such as a television.

2. Description of Related Art

If a television, which is a high-frequency appliance, is used in a strong electric field, a direct wave trespasses on the circuits in the television set, and trouble such as ghost occurs on the picture. Such disturbance of the signal transmittance by the direct wave which occurs to a non-transformer type television is remarkably more serious than that which occurs to a transformer type television. In the transformer type television, once a direct wave trespasses on the chassis of the television, noise will run out through the ground line of the antenna lead-in wire. In the non-transformer type television, on the other hand, since the antenna and the chassis of the television is separated by a capacitor for the purpose of preventing an electrical shock, if a direct wave trespasses on the chassis of the television, noise is prevented from running out by the capacitor. Thereby, the noise potential on the ground lines in the chassis becomes high.

Conventionally, in order to eliminate the direct wave trespassing on the chassis, the following method has been adopted: the antenna lead-in wire is inserted in a hole of a ferrite core. However, this method has not been sufficiently effective, and this component cannot be fitted in a television.

SUMMARY OF THE INVENTION

An object of the present invention is to provide an antenna connector which can be fitted in a high-frequency appliance and can certainly prevent trespassing of noise caused by a direct wave, on the high-frequency appliance even in a strong electric field.

In order to attain the object, an antenna connector according to the present invention comprises a magnetic core, and a signal line which is wound around the magnetic core at least once, and the magnetic core and the signal line form a common mode choke coil. The common mode choke coil shall change the noise on the ground lines of the chassis to common mode noise and equalize the potential between the signal line and the ground line in the chassis. The noise elimination effect can be improved by increasing the number of winding times of the signal line around the core. Since this antenna connector is structured to be independent from an antenna lead-in wire, the antenna connector can be set in any place. Thus, it is possible to fit the antenna connector inside a high-frequency appliance.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Some embodiments of the present invention are hereinafter described with reference to the accompanying drawings.

Figure 1:
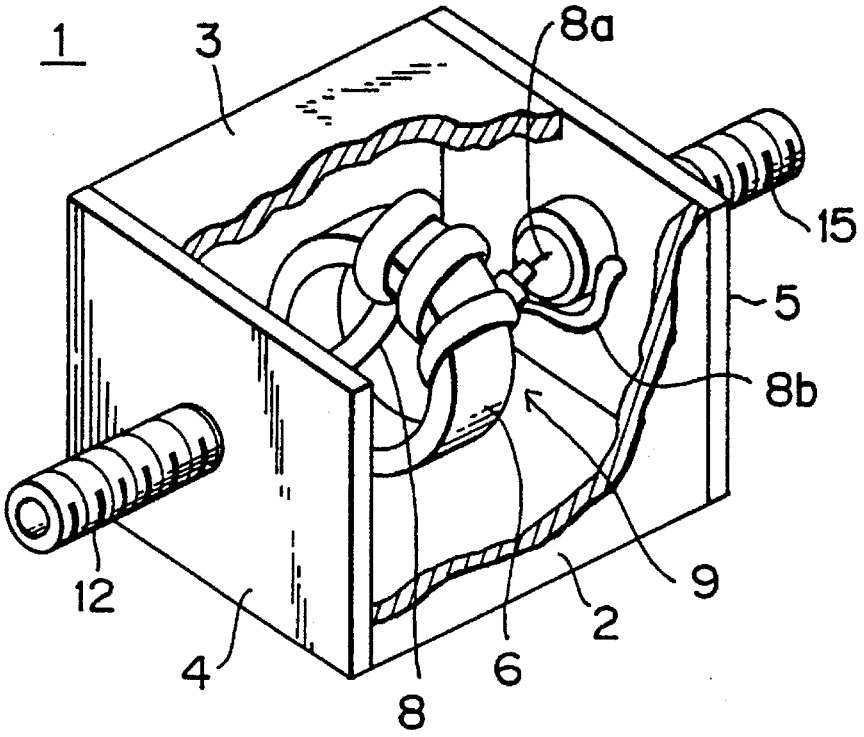
FIG. 1 is a partially cutaway perspective view of an antenna connector which is an embodiment of the present invention.

FIG. 1 shows the structure of an antenna connector 1. The antenna connector 1 has a case 2, and the case 2 contains a ferrite core 6 and a coaxial cable 8 inside. On the case 2, a high-frequency appliance side terminal 12 and an antenna side terminal 15 are fitted. The case 2 consists of a body 3, and side walls 4 and 5 which close openings at both ends of the body 3. The body 3 is made of an insulating material such as plastic. The side walls 4 and 5 are made of a metal, and the terminals 12 and 15 are fitted on the side walls 4 and 5 respectively by caulking. The terminals 12 and 15 have thread grooves on the surfaces, that is, the terminals 12 and 15 are F-type joints.

The ferrite core 6 is a ring, and the coaxial cable 8 is wound around the ferrite core 6 several times. Thus, a common mode choke coil 9 with a large impedance is made. The coaxial cable 8 is connected with the high-frequency appliance side terminal 12 at one end and with the antenna side terminal 15 at the other end. More specifically, a core wire **8*a* of the coaxial cable 8 is electrically connected with signal lines of the terminals 12 and 15, and a shield line 8*b* of the coaxial cable 8 is electrically connected with grounding lines of the terminals 12 and 15. The electrical connections between the coaxial cable 8 and the terminal 12 and between the coaxial cable 8 and the terminal 15** are made by connecting these elements mechanically, for example, by use of springs, or by soldering.

Figure 2:
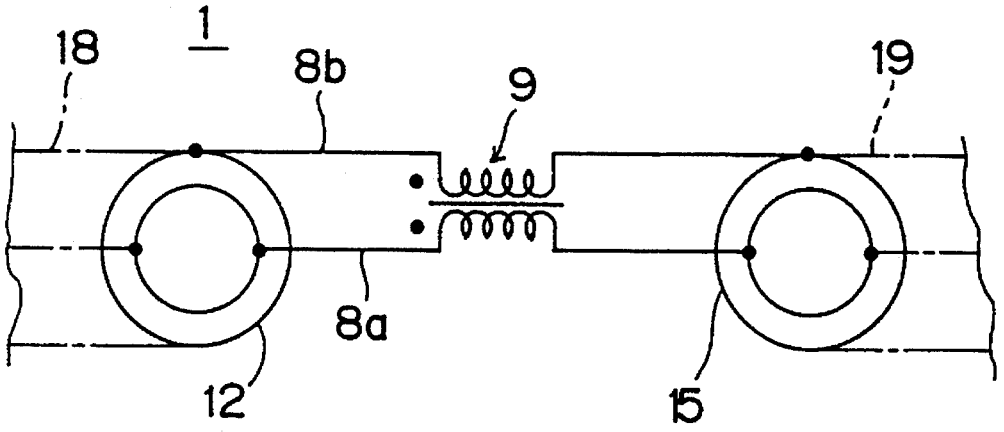
FIG. 2 is an electric equivalent circuit of the antenna connector shown in FIG. 1.

FIG. 2 shows the electrical equivalent circuit of the antenna connector 1 of the above structure. The high frequency appliance side terminal 12 of the antenna connector is electrically connected with a signal line 18 of a television or the like, and the antenna side terminal 15 is electrically connected with an antenna lead-in wire 19. Even in a strong electric field, a direct wave trespassing on the antenna lead-in wire 19 can be eliminated effectively by the common mode choke coil 9, and trouble such as ghost will not occur on the picture. Thus, the antenna connector 1 can transmit only a regular signal sent from an antenna to a high-frequency appliance regardless of the strength of the electric field therearound. Additionally, since the antenna connector i is independent from an antenna lead-in wire, the antenna connector i can be set in any place, for example, the inside of a high-frequency appliance such as a television.

Figure 3:
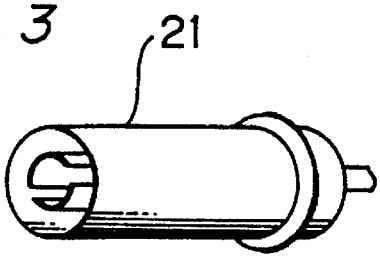
FIG. 3 PRIOR ART
FIG. 3 is a perspective view of a high-frequency appliance side terminal of an antenna connector which is another embodiment of the present invention.
Figure 4:
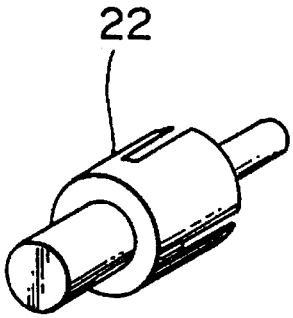
FIG. 4 PRIOR ART
FIG. 4 is a perspective view of an antenna side terminal of an antenna connector which is another embodiment of the present invention.

The high-frequency appliance side terminal and the antenna side terminal do not have to be of the above-described type, and the terminals can be of any type according to the specification. For example, the high-frequency appliance side terminal may be a DIN-type joint 21 shown by FIG. 3, and the antenna side terminal may be an RCA-type joint 22 shown by FIG. 4, an F-type plug or a DIN-type plug.

Figure 5:
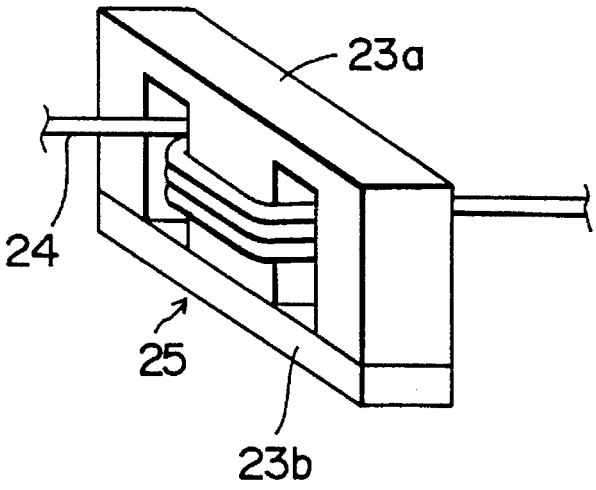
FIG. 5 is a perspective view of a magnetic core of an antenna connector which is another embodiment of the present invention.

The magnetic core may be, as shown in FIG. 5, a combination of an E-shaped ferrite core **23*a* and an I-shaped ferrite core 23***b*. In this case, a coaxial cable 24 is wound around a center leg of the E-shaped ferrite core 23*a* several times, and thereby, a common mode choke coil 25 is formed.

Further, a twin-lead type feeder may be used instead of the coaxial cable.

Although the present invention has been described in connection with the preferred embodiments above, it is to be noted that various changes and modifications are possible to those who are skilled in the art. Such changes and modifications are to be understood as being within the scope of the invention.

What is claimed is:

1. An antenna connector comprising:

a magnetic core which is a combination of an E-shaped core and an I shaped core;

a signal line which pierces through holes of the magnetic core and is wound around the magnetic core at least once;

a case which contains the magnetic core and the signal line inside;

a first terminal which is disposed at one end of the signal line to electrically connect the signal line with a high-frequency appliance, the first terminal being fitted on the case; and a second terminal which is disposed at the other end of the signal line to electrically connect the signal line with an antenna, the second terminal being fitted on the case.

2. An antenna connector as claimed in claim 1, wherein the first terminal and the second terminal are F-type joints.

3. An antenna connector as claimed in claim 1, wherein the first terminal is a DIN-type joint.

4. An antenna connector as claimed in claim 1, wherein the second terminal is an RCA-type plug.

5. An antenna connector as claimed in claim 1, wherein the second terminal is an F-type plug.

6. An antenna connector as claimed in claim 1, wherein the second terminal is a DIN-type plug.

7. An antenna connector as claimed in claim 1, wherein the signal line is a coaxial cable.

8. An antenna connector as claimed in claim 7, wherein the first terminal and the second terminal are F-type joints.

9. An antenna connector as claimed in claim 1, wherein the signal line is a twin-lead type feeder.

10. An antenna connector as claimed in claim 9, wherein the first terminal and the second terminal are F-type joints.

11. An antenna connector as claimed in claim 7, wherein the first terminal is a DIN-type joint.

12. An antenna connector as claimed in claim 11, wherein the second terminal is an RCA-type plug.

13. An antenna connector as claimed in claim 11, wherein the second terminal is an F-type plug.

14. An antenna connector as claimed in claim 11, wherein the second terminal is a DIN-type plug.

15. An antenna connector as claimed in claim 9, wherein the first terminal is a DIN-type joint.

16. An antenna connector as claimed in claim 15, wherein the second terminal is an RCA-type plug.

17. An antenna connector as claimed in claim 15, wherein the second terminal is an F-type plug.

18. An antenna connector as claimed in claim 15, wherein the second terminal is a DIN-type plug.

* * * * *